United States Patent [19]

Koitabashi et al.

[11] 4,049,456

[45] Sept. 20, 1977

[54] LIGHT-SENSITIVE SILVER HALIDE COLOR PHOTOGRAPHIC MATERIAL

[75] Inventors: Takeo Koitabashi; Hideo Akamatsu, both of Hino, Japan

[73] Assignee: Konishiroku Photo Industry Co., Ltd., Tokyo, Japan

[21] Appl. No.: 674,599

[22] Filed: Apr. 7, 1976

[30] Foreign Application Priority Data

Apr. 14, 1975 Japan ..... 50-45466

[51] Int. Cl.[2] ..... G03C 1/14

[52] U.S. Cl. ..... 96/84 R; 96/100 R; 96/124; 96/126

[58] Field of Search ..... 96/126, 124, 100, 84

[56] References Cited

U.S. PATENT DOCUMENTS

| | | | |
|---|---|---|---|
| 2,334,864 | 11/1943 | Carroll et al. | 96/126 |
| 2,398,778 | 4/1946 | Carroll et al. | 96/126 |
| 2,450,748 | 10/1948 | Carroll et al. | 96/126 |
| 2,478,369 | 8/1949 | Carroll et al. | 96/126 |

*Primary Examiner*—J. Travis Brown

*Attorney, Agent, or Firm*—Bierman & Bierman

[57] ABSTRACT

A light-sensitive silver halide photographic material is disclosed which contains a support and a red-sensitive layer. The red-sensitive layer contains at least one sensitizing dye selected from a particular group of sensitizing dyes and at least one sensitizing dye selected from a second group of sensitizing dyes and at least one of a particular group of compounds.

15 Claims, No Drawings

LIGHT-SENSITIVE SILVER HALIDE COLOR PHOTOGRAPHIC MATERIAL

This invention relates to a light-sensitive silver halide color photographic material spectrally super-sensitized with a combination of two different sensitizing dyes and a particular compound, and especially to a light-sensitive silver halide color photographic material, of which a spectral sensitization maximum of a red-sensitive layer among spectrally super-sensitized and multi-coated color photographic emulsion layers is between 595 and 615 mμ and said red-sensitive layer is high in red-sensitivity.

It has heretofore been known that when a silver halide emulsion is incorporated with a sensitizing dye, the sensitive wavelength zone thereof is expanded and thus the emulsion is optically sensitized. Further, in obtaining a desired spectral wavelength zone by spectrally sensitizing a silver halide emulsion, there are used in most cases mixtures of two or more sensitizing dyes, though only one kind of sensitizing dye is used in some cases.

Generally, however, when two or more sensitizing dyes are used in combination, it is usual that the spectral sensitivity thereby obtained is between or less than those obtained when the sensitizing dyes are individually used singly. However, the spectral sensitivity is sometimes markedly enhanced by a particular combination of sensitizing dyes and such phenomenon is commonly called spectral super-sensitization. On the other hand, sensitization of a photographic emulsion by a sensitizing dye is sometimes enhanced by the additional use of a particular compound which is such as stylene compounds, quinoline derivatives and benzoxazole or benzthizaole derivatives as known. These compounds are generally called as a super-sensitizer.

In most of commercially available light-sensitive silver halide color materials, the spectral sensitization maximum of the red-sensitive layer thereof is at 635 to 670 mμ. The photographic characteristics of such light-sensitive silver halide color photographic materials are greatly affected by the kind of light source for the exposure of said materials. For this purpose, therefore optimum color temperature to be employed for the exposure is usually specified and the use of appropriate color temperature conversion filters is recommended for obtaining the optimum color temperature when a light source having a different color temperature is employed for the exposure. This is very inconvenient in photography. Therefore these drawbacks in light-sensitive silver halide color photographic materials heretofore used has been tryed to be improved for example, U.S. Patent No. 2,343,424 discloses that for satisfactory color reproducibility regardless of fine weather or even rainy weather where the color temperatures thereof are different, spectral sensitization maximum of a red-sensitive layer of light-sensitive silver halide photographic materials sensitized by use of sensitizing dyes should preferably be at approximately 600 to 630 mμ. Further, as a process in which a practically satisfactory color reproducibility is obtained in light-sensitive silver halide color photographic materials when used for photographing under any light sources such as day light, tungsten light and light from fluorescent lamps without using any color temperature conversion filters, for example, U.S. Pat. No. 3,672,898 discloses that specific spectral sensitization maximums of a blue-sensitive layer and a green-sensitive layer as well as a red-sensitive layer of light sensitive silver halide color photographic materials for attaining the above purpose are required and that particularly the spectral sensitization maximum of the red-sensitive layer is preferably at about 600 to about 630 mμ. In spite of the above-mentioned knowledge it is still difficult to obtain practically satisfactory photographic materials in this respect for the following reasons:

a. When the spectral sensitization maximum of a red sensitive layer of such light-sensitive silver halide color photographic material is made shorter by the use of a sensitizing dye in order to be between approximately 600 to 630 mμ, the spectral sensitization thereof is low in degree.

b. Sensitizing dyes which spectrally sensitize the layer in the desired wavelength region, are very few in number, and if there are any, such dyes are low in sensitization degree, c. When a sensitizing dye capable of sensitizing ability in such wavelength zone as mentioned above is used in a red-sensitive layer, undesirable sensitization in green beyond red is so increased that the undesired sensitization cannot be compensated by insertion of a green light absorbing filter layer on the red sensitive layer. This results in that the red-sensitive layer thus sensitized is found unsuitable for color photography, and d. Even if a sensitizing dye capable of overcoming the foregoing drawbacks (a), (b) and (c) has become available, there are brought about such difficulties that deterioration of other photographic characteristic or change in the spectral sensitization maximum would occur in the course of manufacturing a light-sensitive silver halide color photographic material by incorporating such sensitizing dye into a color photographic emulsion or when the light-sensitive photographic material thus manufactured is stored for a long period of time, and thus many practical difficulties are involved therein.

Accordingly, an object of the present invention is to provide a light-sensitive silver halide color photographic material free from such drawbacks as mentioned above.

That is, the object of the present invention is to provide a light-sensitive silver halide color photographic material in which a combination of two different sensitizing dyes is used in a red-sensitive layer of said material so that suitable spectral sensitization maximum at 595 to 615 mμ may be attained in addition that red-sensitive layer possess practically satisfactory high speed characteristics. Another object of the present invention is to provide a light-sensitive silver halide color photographic material in which a red-sensitive layer of a color photographic emulsion layer does not indicate any deterioration in photographic characteristic during the storage thereof and that no change in the spectral sensitization maximum takes place in manufacturing the material. The present inventors have found that the above objects can be accomplished by incorporating into a red-sensitive layer of a multi-coated color photographic layer in a light-sensitive silver halide color photographic material a combination of at least one of sensitizing dyes represented by the following general formula (I), at least one of sensitizing dyes represented by the following general formula (II) and at least one of compounds represented by the following general formula (III)

General formula (I)

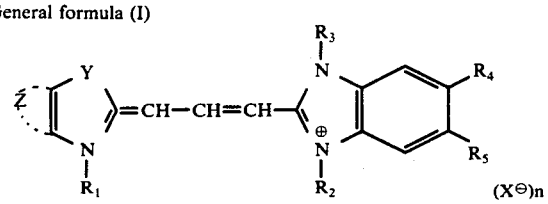

wherein Z is non-matalic atoms necessary to form a substituted or unsubstituted benzene or naphthalene ring; Y is sulfur or selenium; $R_1$ and $R_2$ are individually alkyl, sulfoalkyl, carboxyalkyl, alkoxyalkyl, hydroxyalkyl or aralkyl and at least one of $R_1$ and $R_2$ is carboxyalkyl or sulfoalkyl; $R_3$ is alkyl, acyloxyalkyl, aryl or aralkyl; $R_4$ is hydrogen or halogen; $R_5$ is halogen, —COOR',

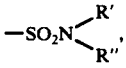

$—CF_3$ or $—SO_2CF_3$ (in which R' is alkyl of 1 to 4 carbon atoms, R'' is hydrogen or alkyl of 1 to 4 carbon atoms); X is an anion and *n* is 0 or 1, and an inner salt is formed when *n* is 0.

General formula (II)

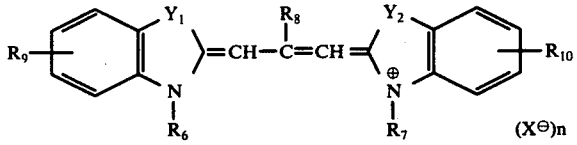

wherein $Y_1$ and $Y_2$ are individually sulfur or selenium; $R_6$ and $R_7$ individually represent a substituent selected from the same group as defined in $R_1$ and $R_2$; $R_8$ is lower alkyl; $R_9$ and $R_{10}$ are individually hydrogen, halogen, alkyl, alkoxy or aryl; X is an anion and *n* is 0 or 1, and an inner salt is formed when *n* is 0.

General formula (III)

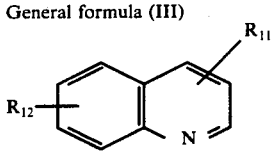

or

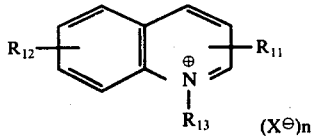

wherein $R_{11}$ and $R_{12}$ are individually hydrogen, halogen, lower alkyl, alkoxy, aryl, aralkyl, cyano, substituted or unsubstituted amino, carboxyalkyl, sulfoalkyl, acyloxyalkyl or hydroxyalkyl; $R_{13}$ is substituted or unsubstituted lower alkyl, alkoxy, aryl, aralkyl, hydroxyalkyl, carboxyalkyl or sulfoalkyl; X is an anion; and *n* is 0 or 1 provided that an inner salt is formed when *n* is 0.

That is, a light-sensitive silver halide color photographic material, in which the spectral sensitization maximum of the red-sensitive layer thereof is at 595 to 615 mμ, and in which no deterioration in photographic characteristics and no change in the spectral sensitization maximum take place in manufacturing said photographic material and during the storage thereof, is obtained by incorporating a combination of the aforesaid two different sensitizing dyes and quinoline derivatives into the red-sensitive layer of the multi-coated color photographic emulsion layers in said photographic material. By virtue of the use of such light-sensitive silver halide color photographic material as mentioned above, practically satisfactory reproduction of color is accomplished even when photographing is effected under changed light sources, for example, from day light to tungsten light or fluorescent lamp, and vice versa.

Representatives of the compounds of general formula (I) in the present invention may include, for example, those which are mentioned below.

(I-1)

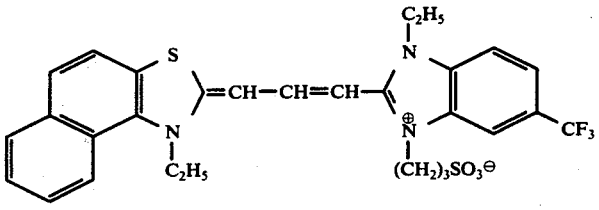

(I-2)

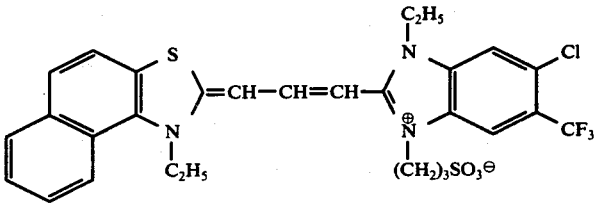

(I-3)

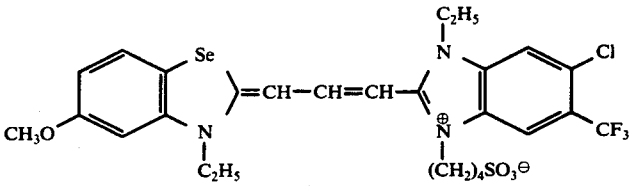

-continued
(I-4)
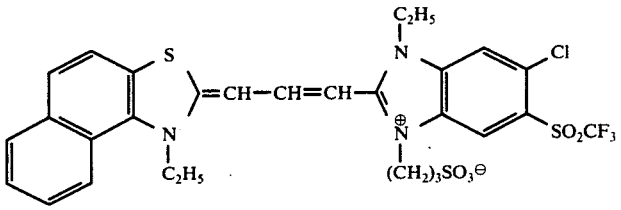
(I-5)
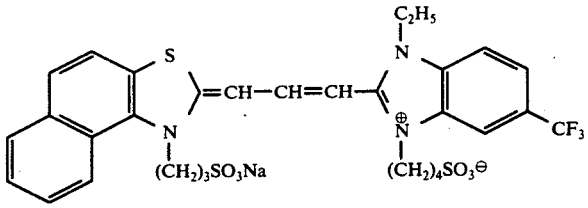
(I-6)
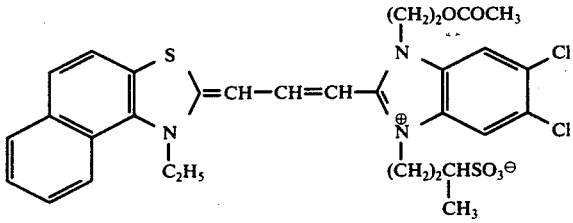
(I-7)
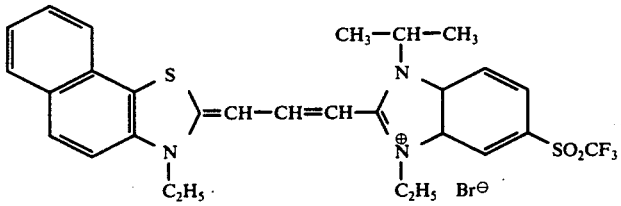
(I-8)
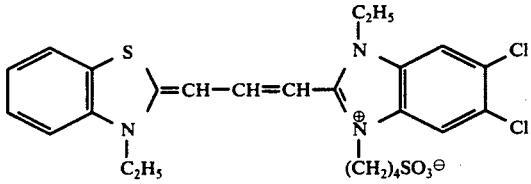
(I-9)
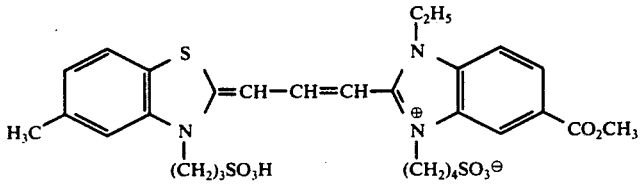
(I-10)
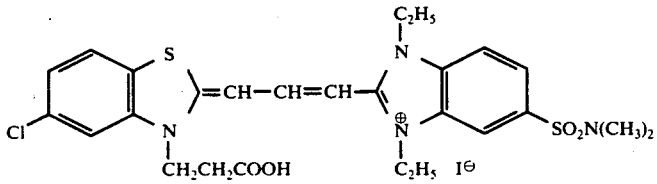

-continued
(I-11)
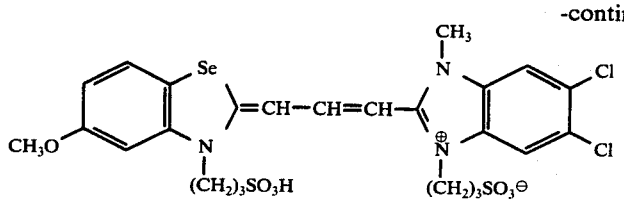
(I-12)
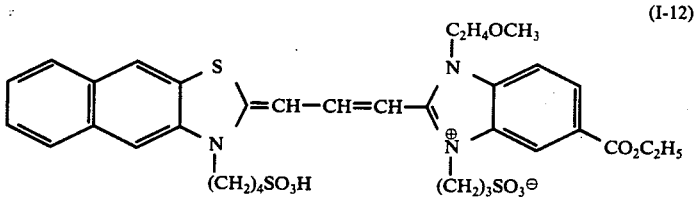
(I-13)
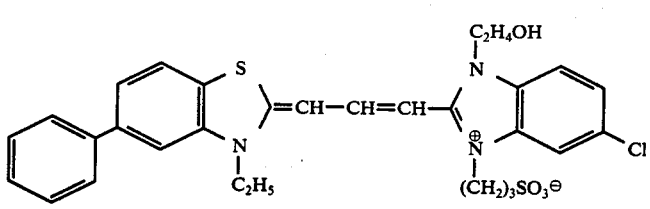
(I-14)
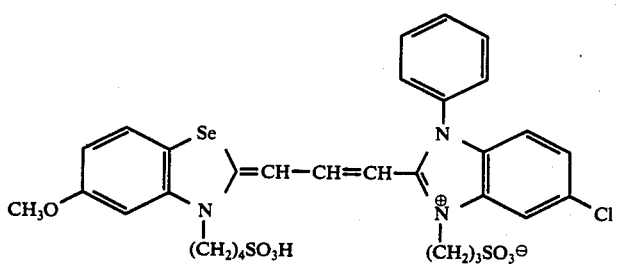
Typical examples of the sensitizing dyes represented by general formula (II) are as follows:
(II-1)
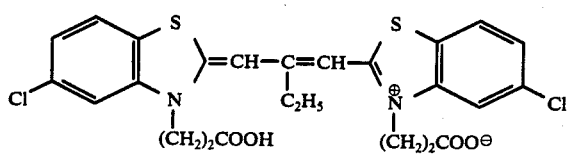
(II-2)
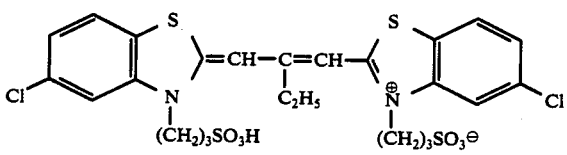
(II-3)
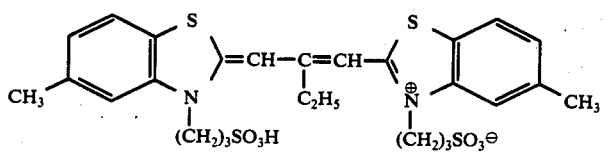
(II-4)
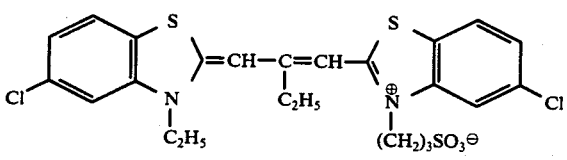

-continued (II-5)

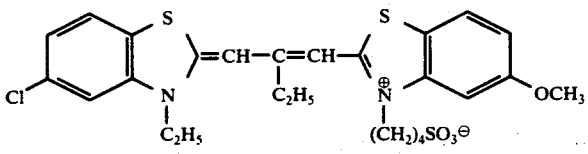

(II-6)

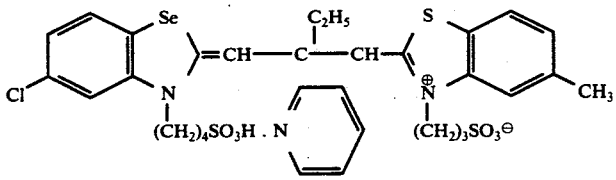

(II-7)

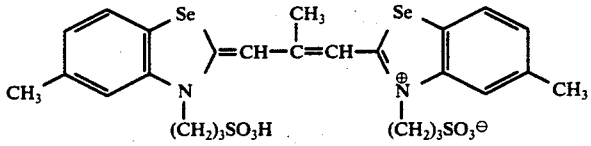

(II-8)

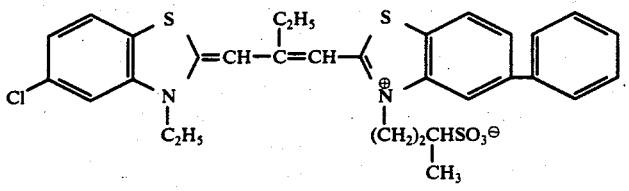

(II-9)

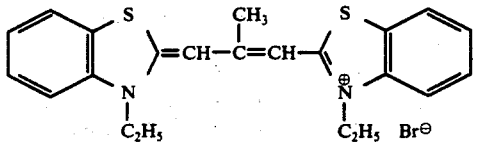

(II-10)

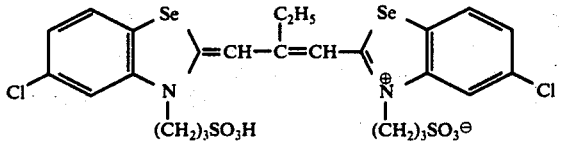

When the above-mentioned sensitizing dyes are used in combination, the weight ratio of the amount of a dye of general formula (I) to the amount of a dye of general formula (II) may be varied, according to a desired spectral sensitization maximum, within the range from 9 : 1 to 3 : 7. Further, the two kinds of sensitizing dyes according to the present invention may also be used in combination with other sensitizing dyes if necessary. For instance, when the necessity arises to further extend a spectral sensitization wavelength zone so as to include a longer wavelength zone, a sensitizing dye of the following structural formula may preferably be used in combination with the present two kinds of sensitizing dyes and, if necessary, a sensitizing dye different in structure for a shorter wavelength sensitization may further be used in combination therewith.

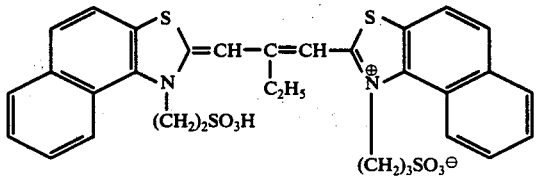

Representative examples of the compounds of general formula III are:

(III-1)

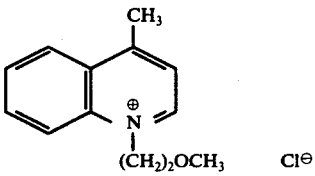

-continued (III-2)

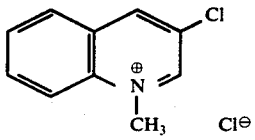

(III-3)

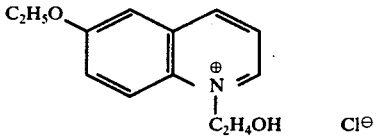

(III-4)

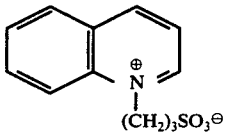

(III-5)

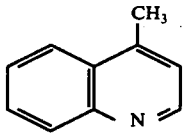

(III-6)

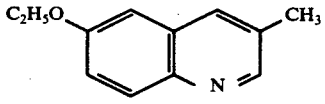

(III-7)

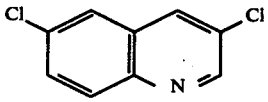

(III-8)

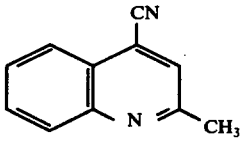

(III-9)

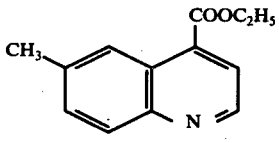

(III-10)

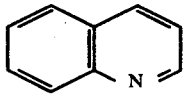

(III-11)

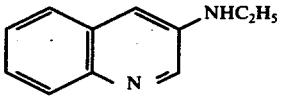

(III-12)

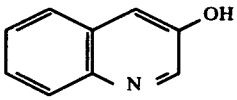

-continued (III-13)

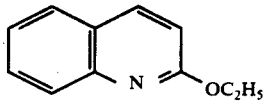

(III-14)

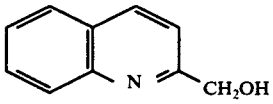

(III-15)

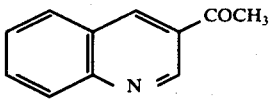

(III-16)

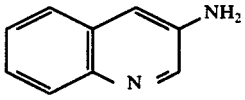

Incorporation of the sensitizing dyes of general formulas (I) and (II) and quinoline derivatives according to the present invention into a silver halide emulsion layer to be used for forming multi-coated color photographic emulsion layers may be carried out by that the dyes and compounds have been dissolved in an appropriate solvent such as methyl alcohol, ethyl alcohol and tetrafluoropropanol. The amounts of the sensitizing dyes to be incorporated are individually in the range from 10 mg to 1 g., preferably from 50 to 300 mg., per mole of silver halide, and said dyes may be incorporated into a silver halide emulsion during or at the end of the chemical ripening thereof.

The amount to be used of the quinoline derivatives is generally 100 mg to 10 g, preferably 500 mg to 6 g and is preferred to be 0.5 to 30 times of the combined amounts of the sensitizing dyes. The addition of the derivative into the emulsion can be performed at any step during chemical ripening, preferably at the same time or right after when the sensitizing dyes are added.

Preferably useful as silver halide emulsions for forming the multi-coated color photographic emulsion layers according to the present invention, is silver chloride, silver bromide, silver chlorobromide, silver iodobromide, or silver chloroiodobromide, preferably silver iodobromide.

Such the silver halide emulsion layer may be of more than two layers different in sensitivity due to different silver halide emulsions or may include a mixture of different silver halide emulsion in order to improve photographic characteristics such as for broader latitude for exposure.

When a red-sensitive layer is sensitized by the use of a combination of two kinds of sensitizing dyes of the present invention, to have its spectral sensitization maximum at such short wavelength as 600 mμ, it sometimes happens that the red-sensitive layer may have excessive green-sensitivity. However, in this case, it is prefered to provide a green light abosrbing filter layer on the red-sensitive layer. Usually, magenta acid dyes are used in said filter layer for achieving that purpose.

Further, in case such dyes tend to move from the filter layer to a silver halide emulsion layer by diffusion, it is preferable to use appropriate mordants such as reaction products of a carbonyl-containing polymers with amino guanidine or salts thereof disclosed in U.S. Pat. No. 2,882,156, etc.

As couplers used in the light-sensitive silver halide color photographic material of the present invention, which couplers react during color development with an oxidation product of an aromatic primary amino developing agent to form a dye, there may be mentioned, for example, phenol type, 5-pyrazolone type and open chain ketomethylene type compounds. The phenol type coupler which forms a cyan dye as a result of the reaction may include, for example, those which are mentioned below.

(C-1)

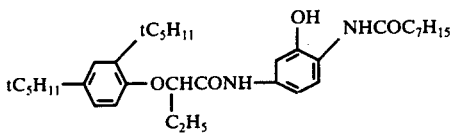

(C-2)

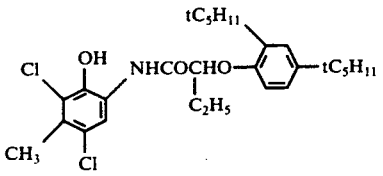

-continued (C-3)

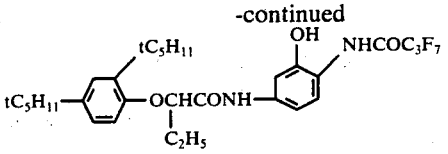

(C-4)

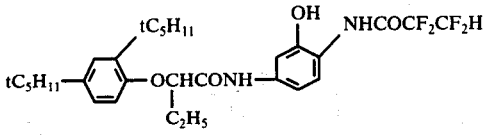

(C-5)

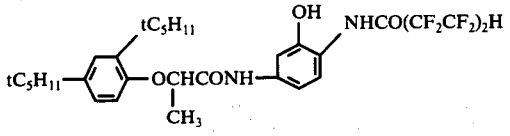

(C-6)

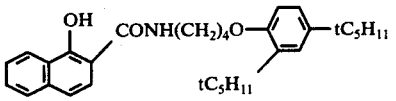

(C-7)

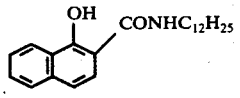

Typical examples of 5-pyrazolone couplers for forming a magenta dye are:

(M-1)

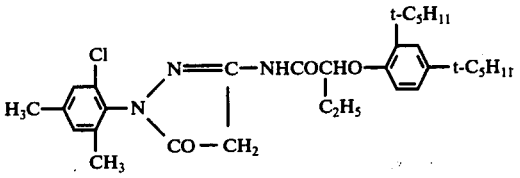

(M-2)

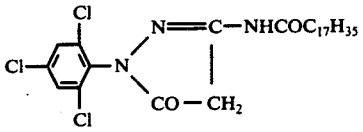

(M-3)

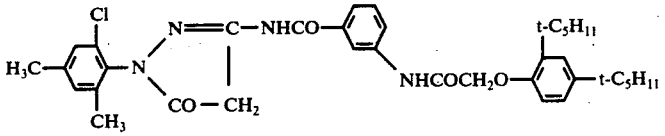

(M-4)

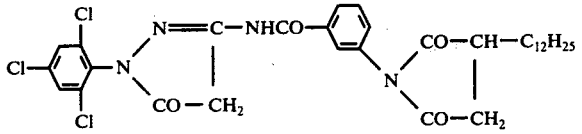

(M-5)

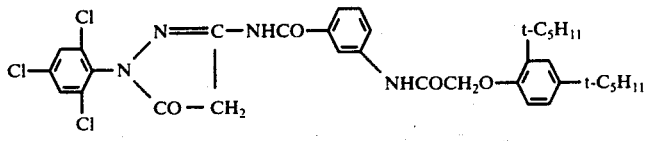

-continued
(M-6)
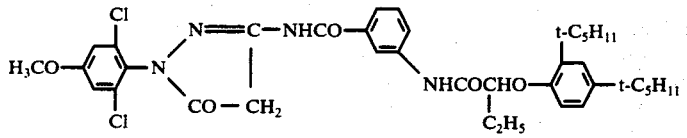
(M-7)
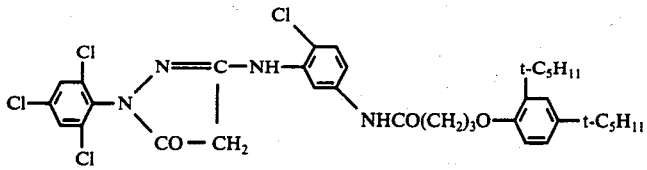
(M-8)
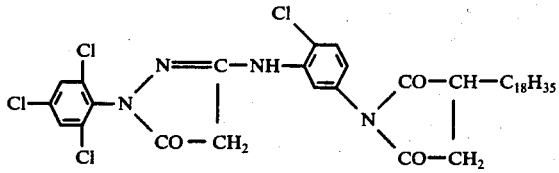
(M-9)
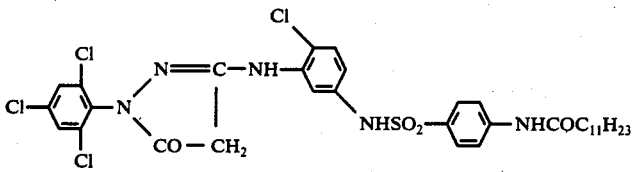
(M-10)
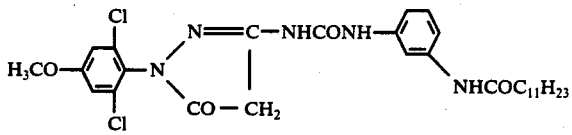
(M-11)
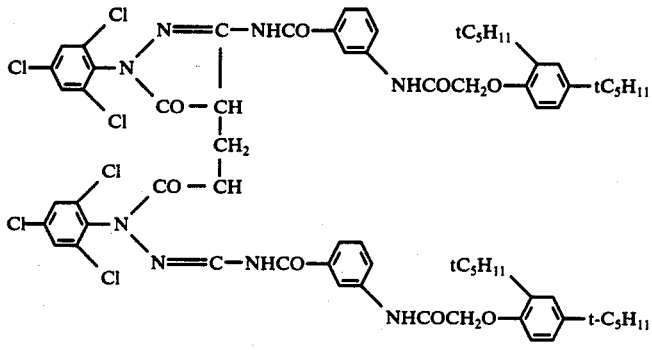
(M-12)
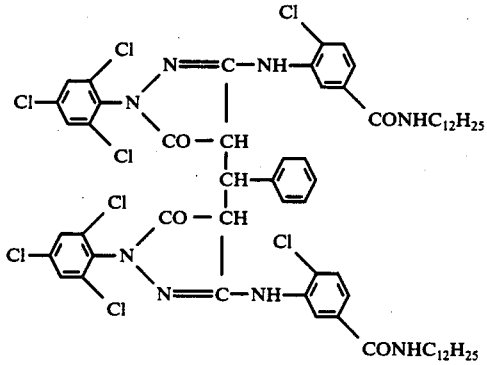
Typical open chain ketomethylene type couples for a yellow dye are:

(Y-1)
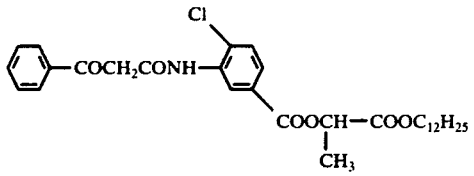
(Y-2)
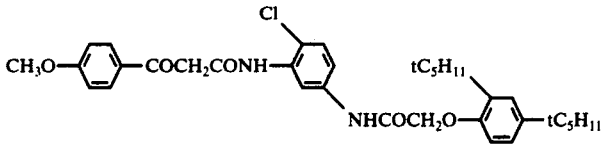
(Y-3)
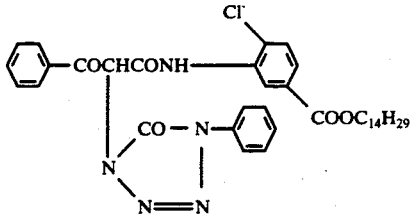
(Y-4)
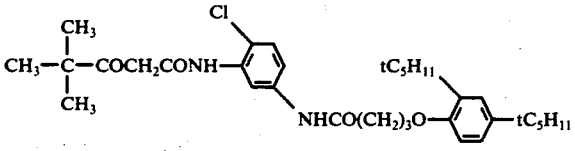
(Y-5)
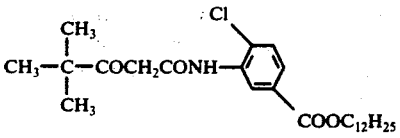
(Y-6)
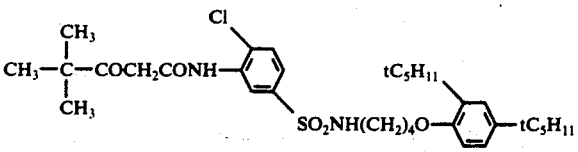
(Y-7)
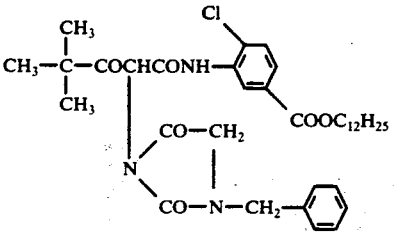
(Y-8)
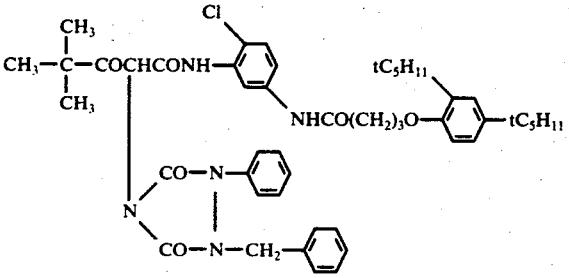

-continued (Y-9)

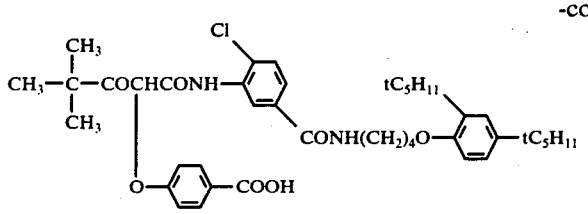

(Y-10)

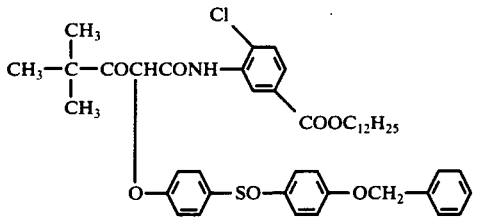

Further, if a colored coupler for automasking is used in combination therewith, better reproduction in color is attained.

Incorporation of the aforementioned couplers into a silver halide emulsion may be satisfactorily carried out by that the coupler is first dispersed in a high boiling organic solvent or dissolved in an alkali solution.

The present invention is explained in more detail by the following examples but not intended to be limited in scope.

EXAMPLE 1

A silver halide iodobromide emulsion containing 6 mole % of silver iodide and having 0.8 $\mu$ of grain size of the silver halide as disclosed in Japanese Laid-open-to-public No. 65925/1973 was sensitized by noble metal sensitization and sulfur sensitization and incorporated with a tetrazaindene compound as a stabilizer, mucochloric acid as a gelatin hardner, saponin as a coating agent, and the following dispersion so as to include a coupler in an amount of 12 mole % based on silver halide, the dispersion comprising cyan coupler (C-6):

| Cyan Coupler Dispersion | |
|---|---|
| coupler | 10 g |
| tricresylphosphate | 20 ml |
| ethylacetate | 60 ml |

This was heated at 60° C to completely dissolve the coupler, thereafter mixed with 5 ml of 10% aqueous solution of a Alkanol XC (from Du Pont) and 200 ml of 5% aqueous gelatin solution and then emulsified by colloid mill in order to obtain the coupler dispersion. The silver halide emulsion thus obtained was devided into 26 portions each of which was incorporated with sensitizing dye group I, sensitizing dye group II and/or quinoline group III as indicated Table 1 listed later, to obtain 26 red sensitive emulsions. These emulsions were individually coated on triacetate film having an anti-halation layer and a gelatin layer thereon to obtain 26 red sensitive silver halide color film samples including comparative samples 1 to 19 and samples 20 to 26. The coating was carried out so that the amount of silver is 17 mg per 100 cm² of the film.

The samples and comparative samples thus prepared were individually exposed to light by means of a sensitometer using a spectrometer and a yellow filter and then processed according to the following processing steps with processing solutions as indicated below.

| Processing step | Processing time | Processing temperature |
|---|---|---|
| First development | 3 minutes | 38° C |
| First stopping | 0 minute 30 seconds | " |
| Water washing | 1 minute | " |
| Color development | 3 minutes 40 seconds | 43° C |
| Second stopping | 0 minute 30 seconds | 38° C |
| Water washing | 1 minute | " |
| Bleaching A | 6 minutes | " |
| Fixing | 6 minutes | " |
| Water Washing | 3 minutes | " |
| Stabilization | 0 minute 30 seconds | " |

In the above processing, when the bleaching step was carried out using a bleaching solution B mentioned later, the processing time employed was 1 minute 30 seconds. Further, pre-hardening and neutralization may be effected, if necessary, prior to the first development.

| | |
|---|---|
| First developer: | |
| Sodium polyphosphate | 2.0 g |
| Sodium hydrogen sulfite (anhydride) | 8.0 g |
| Phenidon | 0.35 g |
| Sodium sulfite | 37.0 g |
| Hydroquinone | 5.5 g |
| Sodium carbonate | 33.0 g |
| Sodium thiocyanate (10 % aqueous solution) | 13.8 ml |
| Sodium bromide | 1.3 g |
| Potassium iodide (0.1 % aqueous solution) | 13.0 ml |
| Water to make | 1 liter |
| Adjusted to pH 9.9 ± 1 | |
| First and second stopping solutions: | |
| Sodium hydroxide | 1.77 g |
| Glacial acetic acid | 30.0 ml |
| Water to make | 1 liter |
| Adjusted to pH 3.8 | |
| Color developer: | |
| Sodium polyphosphate | 5.0 g |
| Benzyl alcohol | 4.5 g |
| Sodium sulfite | 7.5 g |
| Trisodium phosphate dodecahydrate | 36.0 g |
| Sodium bromide | 0.9 g |
| Potassium iodide (0.1 % aqueous solution) | 90.0 ml |
| 4-amino-N-ethyl-N-($\beta$-methanesulfoneamido-ethyl)-m-toluidine sesquisulfate mono-hydrate | 11.0 g |
| Ethyleneamine | 3.0 g |
| t-Butylaminoborane hydride | 0.07 g |
| Water to make | 1 liter |
| Adjusted with sodium hydroxide to pH 11.65 ± 0.1 | |
| Bleaching solution A: | |
| Ferric ammonium EDTA | 170 g |
| Ammonium bromide | 300 g |
| Water to make | 1 liter |
| Adjusted to PH 5.8 - 6.0 | |
| Bleaching solution B: | |
| Potassium ferricyanide | 165 g |
| Sodium bromide | 43 g |

-continued

| | |
|---|---|
| Water to make | 1 liter |
| Adjusted to pH 8.7 ± 0.15 | |
| Fixing solution: | |
| Sodium thiosulfate (anhydride) | 94.5 g |
| Sodium hydrogen sulfite (anhydride) | 17.6 g |
| Sodium diphosphate (anhydride) | 15.0 g |
| Water to make | 1 liter |
| Adjusted to pH 5.9 ± 0.2 | |
| Stabilizing solution: | |

-continued

| | |
|---|---|
| Polyoxyethylene ether | 0.15 g |
| Ethyl alcohol | 2.0 ml |
| Formaldehyde (37.5 % solution) | 6.0 g |
| Water to make | 1 liter |

The thus processed samples were individually measured in speed and spectral sensitization maximum to obtain the results as shown in Table 1.

Table 1

| Sample | | Photographic characteristics | | | | |
|---|---|---|---|---|---|---|
| | | Sensitizing dyes and the Amounts thereof per mole of silver halide | | Super sensitizers and the amounts thereof per mole of silver halide | Spectral sensitization maximum (mμ) | Red sensitivity |
| Comparative sample | 1 | Sensitizing Dye (I-1) 95 mg | — | — | 580 | 10 |
| | 2 | Sensitizing Dye (I-2) 95 mg | — | — | 590 | 15 |
| | 3 | Sensitizing Dye (I-5) 95 mg | — | — | 585 | 11 |
| | 4 | — | Sensitizing Dye (II-1) 65 mg | — | 650 | 45 |
| | 5 | — | Sensitizing Dye (II-2) 65 mg | — | 645 | 30 |
| | 6 | — | Sensitizing Dye (II-3) 65 mg | — | 650 | 47 |
| | 7 | Sensitizing Dye (I-1) 95 mg | — | (III-1) 3 g | 580 | 10 |
| | 8 | Sensitizing Dye (I-2) 95 mg | — | (III-2) 2 g | 590 | 15 |
| | 9 | Sensitizing Dye (I-3) 95 mg | — | (III-3) 2 g | | |
| | 10 | — | Sensitizing Dye (II-1) 65 mg | (III-1) 3 g | 650 | 45 |
| | 11 | — | Sensitizing Dye (II-2) 65 mg | (III-2) 2 g | 645 | 30 |
| | 12 | — | Sensitizing Dye (II-3) 65 mg | (III-3) 2 g | 650 | 47 |
| | 13 | Sensitizing Dye (I-1) 95 mg | Sensitizing Dye (II-1) 65 mg | — | 620 | 60 |
| | 14 | Sensitizing Dye (I-2) 95 mg | Sensitizing Dye (II-2) 65 mg | — | 615 | 65 |
| | 15 | Sensitizing Dye (I-3) 95 mg | Sensitizing Dye (II-3) 65 mg | — | 625 | 66 |
| | 16 | Sensitizing Dye (I-4) 95 mg | Sensitizing Dye (II-4) 65 mg | — | 630 | 63 |
| | 17 | Sensitizing Dye (I-5) 95 mg | Sensitizing Dye (II-5) 65 mg | — | 635 | 60 |
| | 18 | Sensitizing Dye (I-6) 95 mg | Sensitizing Dye (II-6) 65 mg | — | 635 | 60 |
| | 19 | Sensitizing Dye (I-7) 95 mg | Sensitizing Dye (II-7) 65 mg | — | 630 | 40 |
| | 20 | Sensitizing Dye (I-1) 95 mg | Sensitizing Dye (II-1) 65 mg | (III-1) 3 g | 605 | 70 |
| | 21 | Sensitizing Dye (I-2) 95 mg | Sensitizing Dye (II-2) 65 mg | (III-2) 2 g | 600 | 75 |
| | 22 | Sensitizing Dye (I-5) 95 mg | Sensitizing Dye (II-3) 65 mg | (III-3) 2 g | 608 | 66 |
| | 23 | Sensitizing Dye (I-8) 95 mg | Sensitizing Dye (II-4) 65 mg | (III-4) 2 g | 610 | 68 |
| | 24 | Sensitizing Dye (I-10) 95 mg | Sensitizing Dye (II-5) 65 mg | (III-5) 2 g | 615 | 65 |
| | 25 | Sensitizing Dye | Sensitizing Dye | | 615 | 65 |

Table 1-continued

| Sample | | Photographic characteristics: Sensitizing dyes and the Amounts thereof per mole of silver halide | | Super sensitizers and the amounts thereof per mole of silver halide | Spectral sensitization maximum (mμ) | Red sensitivity |
|---|---|---|---|---|---|---|
| | 26 | (I-11) 95 mg Sensitizing Dye (I-12) 95 mg | (II-6) 65 mg Sensitizing Dye (II-7) 65 mg | (III-6) 2 g (III-7) 2 g | 609 | 67 |

From Table 1, it is understood that the sample in which two kinds of sensitizers were used in combination with the super-sensitizer had its spectral sensitization maximum shortened by about 20 mμ and increased red sensitivity.

EXAMPLE 2

A silver halide emulsion was prepared in the same way as set forth in Example 1 except that size of iodobromide grains is 0.4 μ and that mixture (1 : 1) of cyan couplers C-3 and C-6 were employed in place of cyan coupler C-6.

The emulsion was devided into 11 portions, each of which were incorporated with sensitizer group I, sensitizer group II, and/or super-sensitizer group III; or comparative compounds group IV as indicated in Table 2, so that 11 red sensitive emulsions were obtained.

These emulsions were individually coated on triacetate films each having an anti-halation layer and a gelatin layer thereon so that the amount of silver was 17 mg per 100 $cm^2$ of the film.

The thus obtained 11 red sensitive silver halide color films were individually coated with a green sensitive layer and a yellow filter layer thereon, the green sensitive layer containing magenta coupler of M-5 in an amount of 13 mole % based on silver halide. A blue sensitive layer containing yellow coupler Y-8 in an amount of 30 mole % based on silver halide and a gelatin protective layer were provided on the filter layer in this order to obtain 11 multi-layer silver halide color photosensitive material samples including samples 34 to 37 and comparative samples 27 to 33. In the above, the same compositions were coated under the same conditions as to the green sensitive layer and the blue-sensitive layer in each of the samples.

On the other hand, the following comparative sensitizing dye was employed for comparison.

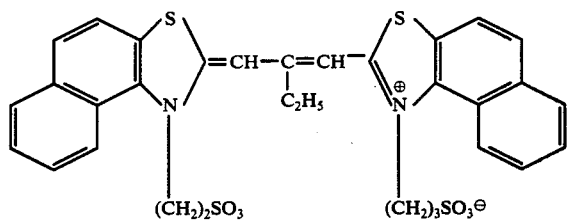

The so-prepared samples and comparative samples were processed according to the same method as described in Example 1 to measure a red-sensitivity and spectral sensitization maximum. The results are shown in Table 2.

Table 2

| Sample | | Photographic characteristics: Sensitizing dyes and the amount thereof per mole of silver halide | Super sensitizer and the amount thereof per mole of silver halide | Spectral sensitization maximum (mμ) | Red sensitivity |
|---|---|---|---|---|---|
| Comparative sample | 27 | Sensitizing Dye (I-1) 140 mg + Sensitizing Dye (II-2) 85 mg | — | 620 | 45 |
| | 28 | Sensitizing Dye (I-10) 140 mg + Sensitizing Dye (II-12) 85 mg | — | 624 | 38 |
| | 29 | Sensitizing Dye (I-12) 140 mg + Sensitizing Dye (II-13) 85 mg | — | 622 | 44 |
| | 30 | Sensitizing Dye (II-2) 100 mg + Comparative sensitizing Dye 21 mg | — | 660 | 75 |
| | 31 | Sensitizing Dye (II-3) 100 mg + Comparative sensitizing Dye 21 mg | — | 655 | 66 |
| | 32 | Sensitizing Dye (II-2) 100 mg + Comparative sensitizing Dye 21 mg | (III-1) 2 g | 660 | 75 |
| | 33 | Sensitizing Dye (II-3) 100 mg + | | 655 | 66 |

Table 2-continued

| Sample | Photographic characteristics: Sensitizing dyes and the amount thereof per mole of silver halide | Super sensitizer and the amount thereof per mole of silver halide | Spectral sensitization maximum (mμ) | Red sensitivity |
|---|---|---|---|---|
| | Comparative sensitizing Dye 21 mg | (III-6) 2 g | | |
| 34 | Sensitizing Dye (I-1) 140 mg + Sensitizing Dye (II-1) 85 mg + Comparative sensitizing Dye 6 mg | (III-1) 2 g | 609 | 60 |
| 35 | Sensitizing Dye (I-1) 140 mg + Sensitizing Dye (II-2) 85 mg | (III-1) 2 g | 608 | 52 |
| 36 | Sensitizing Dye (I-10) 140 mg + Sensitizing Dye (II-12) 85 mg | (III-10) 2 g | 610 | 42 |
| 37 | Sensitizing Dye (I-12) 140 mg + Sensitizing Dye (II-13) 85 mg | (III-15) 2 g | 606 | 53 |

From Table 2, it is obviously understood that the combinations of sensitizing dyes I and II and super-sensitizer III can shift the spectral sensitization maximum to be shorter as well as showing excellent sensitization. Further the comparative sensitizing dye can be added to the combination to increase the spectral sensitivity without substantial change in the spectral sensitization maximum.

In addition, when the red-sensitive emulsions in samples 34 to 35 were stored at 40° C for 4 hours and thereafter coated, no substantial deference was found in composition with the above samples in which the red-sensitive emulsion were immediately coated without storage.

What is claimed is:

1. A light-sensitive silver halide color photographic material comprising a support and a red sensitive layer which comprises, in the layer, at least one of the sensitizing dyes represented by the following formula I, at least one of the sensitizing dyes represented by the following formula II and at least one compound represented by the following formula III:

Formula I:

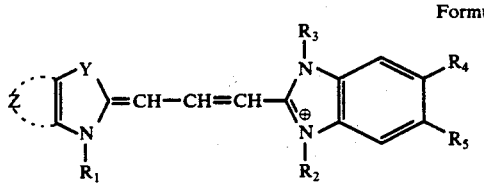

wherein Z is the non-metalic atoms necessary to form a benzene or naphthalene ring which may have substituents selected from the group consisting of lower alkoxy, halogen, lower alkyl, and phenyl; Y is sulfur or selenium; $R_1$ and $R_2$ are individually alkyl, sulfoalkyl, carboxyalkyl, alkoxyalkyl, hydroxyalkyl or aralkyl and at least one of $R_1$ and $R_2$ is carboxyalkyl or sulfoalkyl; $R_3$ is alkyl, acyloxyalkyl, aryl or aralkyl; $R_4$ is hydrogen or halogen; $R_5$ is halogen, —COOR',

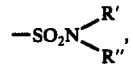

—$CF_3$ or —$SO_2CF_3$ (in which R' is alkyl of 1 to 4 carbon atoms); X is an anion and *n* is 0 or 1, and an inner salt is formed when *n* is 0;

Formula II:

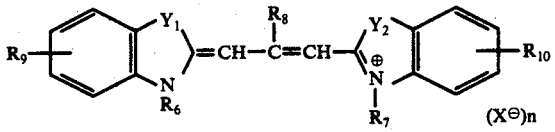

wherein $Y_1$ and $Y_2$ are individually sulfur or selenium; $R_6$ and $R_7$ individually represent a substitutent selected from the same group as defined in $R_1$ and $R_2$; $R_8$ is lower alkyl; $R_9$ and $R_{10}$ are individually hydrogen, halogen, alkyl, alkoxy or aryl; X is an anion and *n* is 0 or 1, and an inner salt is formed when *n* is 0;

Formula III:

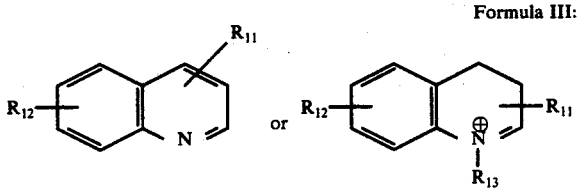

wherein $R_{11}$ and $R_{12}$ are individually selected from the group consisting of hydrogen, halogen, lower alkyl, alkoxy, aryl, aralkyl, cyano, amino, lower alkyl-substituted amino, carbonylalkyl, sulfoalkyl, acyloxyalkyl or hydroxyalkyl; $R_{13}$ is lower alkyl, aralkyl, hydroxyalkyl, carboxyalkyl, sulfoalkyl or lower alkoxy alkyl; X is an anion; and *n* is 0 or 1, provided that an inner salt is formed when *n* is 0.

2. A photosensitive material according to claim 1 wherein the amounts of the sensitizing dyes of formulas I and II are individually 50 to 300 mg per mole of silver halide.

3. A photosensitive material according to claim 1 wherein the amount of the compound of formula III is 500 mg to 6 g per mole of silver halide.

4. A photosensitive material according to claim 3 wherein the amounts of the sensitizing dyes are individually 5 to 300 mg per mole of silver halide.

5. A photosensitive material according to claim 4 wherein the amount of the compound is 0.5 to 30 times of the amount of the sensitizing dyes.

6. A photographic material according to claim 5 wherein the red-sensitive layer contains a cyan coupler.

7. A photosensitive material according to claim 6 wherein the material further contains a green light absorbing layer on the red sensitive layer.

8. A photosensitive material according to claim 1 wherein $R_5$ is halogen or $—CF_3$ in the sensitizing dye represented by formula I.

9. A photosensitive material according to claim 1 wherein $R_{11}$ is a halogen or lower alkyl in the compound represented by formula III.

10. A photosensitive material according to claim 9 wherein $R_5$ is halogen or $—CF_3$ in the sensitizing dye represented by formula I.

11. The photographic material according to claim 1 wherein $R_{11}$ and $R_{12}$ are ethyl-substituted amino.

12. The photographic material according to claim 1 wherein $R_{13}$ is methoxyethyl.

13. The photographic material according to claim 1 wherein the substituents for benzene and naphthalene are selected from methoxy, chlorine, and phenyl.

14. A light-sensitive silver halide color photographic material comprising a support and a red-sensitive layer which comprises, in the layer, at least one of the sensitizing dyes represented by the following formula I, at least one of the sensitizing dyes represented by the following formula II and at least one compound selected from the group consisting of compounds represented by the following formulas (III-1 ) to (III-16):

Formula I:

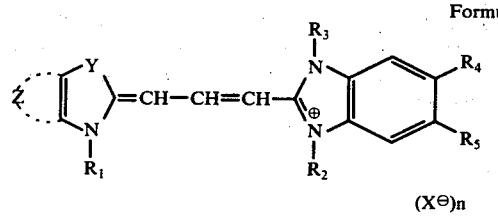

wherein Z is non-metalic atoms necessary to form a benzene or naphthalene ring which may have substituents selected for the group consisting of lower alkoxy, lower alkyl, halogen, and phenyl; Y is sulfur or selenium; $R_1$ and $R_2$ are individually alkyl, sulfoalkyl, carboxyalkyl, alkoxyalkyl, hydroxyalkyl or aralkyl and at least one of $R_1$ and $R_2$ is carboxyalkyl or sulfoalkyl; $R_3$ is alkyl, acyloxyalkyl, aryl or aralkyl; $R_4$ is hydrogen or halogen; $R_5$ is halogen, —COOR',

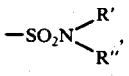

$—CF_3$ or $—SO_2CH_3$ (in which R' is alkyl of 1 to 4 carbon atoms, R'' is hydrogen or alkyl or 1 to 4 carbon atoms); X is an anion and $n$ is 0 or 1, and an inner salt is formed when $n$ is 0;

Formula II:

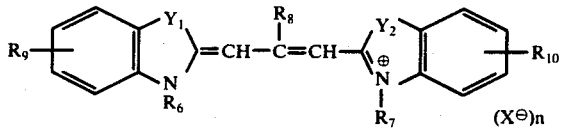

wherein $Y_1$ and $Y_2$ are indivudually sulfur or selenium; $R_6$ and $R_7$ individually represent a substituent selected from the same group as defined in $R_1$ and $R_2$; $R_8$ is lower alkyl; $R_9$ and $R_{10}$ are individually hydrogen, halogen, alkyl, alkoxy or aryl; X is an anion and $n$ is 0 or 1, and an inner salt is formed when $n$ is 0;

(III-1)

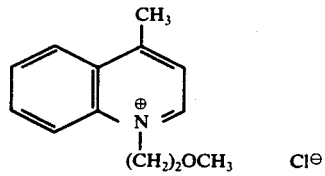

(III-2)

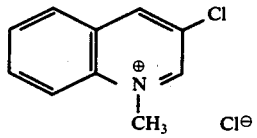

(III-3)

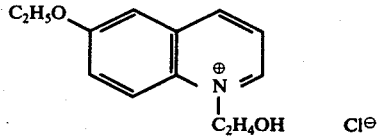

(III-4)

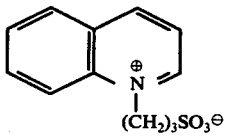

(III-5)

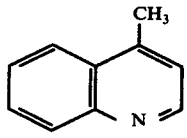

(III-6)

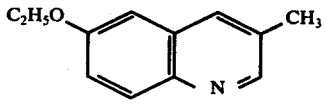

(III-7)

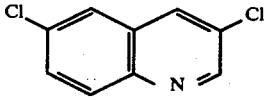

(III-8)

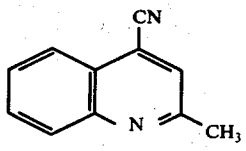

-continued
(III-9)
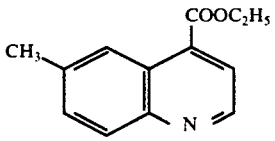
(III-10)
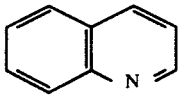
(III-11)
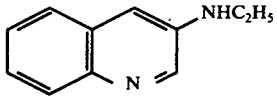
(III-12)
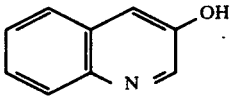
(III-13)
-continued
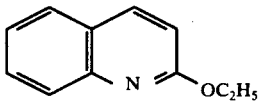
(III-14)
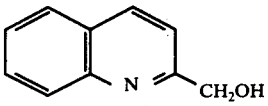
(III-15)
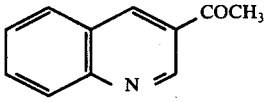
(III-16)
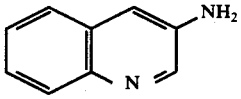
15. The photographic material according to claim 14 wherein the sutstituents for benzene and naphthalene are selected from methoxy, methyl, chlorine, and phenyl.
* * * * *